US005493975A

United States Patent [19]

Franzini et al.

[11] Patent Number: 5,493,975

[45] Date of Patent: Feb. 27, 1996

[54] CARTRIDGE FOR A POWER DRIVEN TOOL

[75] Inventors: John A. Franzini, Salem; Gennaro L. Pecora, Manchester, both of N.H.

[73] Assignee: Burndy Corporation, Norwalk, Conn.

[21] Appl. No.: 391,918

[22] Filed: Feb. 21, 1995

[51] Int. Cl.[6] ..... C06D 5/00

[52] U.S. Cl. ..... 102/531; 102/470; 227/9

[58] Field of Search ..... 102/204, 430, 102/447, 464–470, 472, 520, 523, 530, 531, 532; 227/9, 10, 11; 60/632, 637, 638; 89/1.14

[56] References Cited

U.S. PATENT DOCUMENTS

| | | | |
|---|---|---|---|
| Re. 33,098 | 10/1989 | Center | 60/635 |
| 2,920,563 | 1/1960 | De Caro . | |
| 3,053,185 | 9/1962 | Oberfell et al. | 102/532 |
| 3,404,598 | 10/1968 | Angelos . | |
| 3,424,088 | 1/1969 | Gahle . | |
| 3,439,614 | 4/1969 | Schnepfe, Jr. | 102/530 |
| 3,477,374 | 11/1969 | Barr | 102/470 |
| 3,604,355 | 9/1971 | Greenlees | 105/530 |
| 3,885,500 | 5/1975 | Bornand | 102/470 |
| 3,951,071 | 4/1976 | Germershausen | 102/523 |
| 4,646,643 | 3/1987 | Goldenberg | 102/464 |
| 4,913,055 | 4/1990 | Goto et al. | 102/531 |
| 4,945,730 | 8/1990 | Laney | 60/635 |
| 5,005,485 | 1/1991 | Woo et al. | 102/531 |

FOREIGN PATENT DOCUMENTS

| | | | |
|---|---|---|---|
| 563555 | 6/1957 | Italy | 102/532 |
| 57203 | 10/1936 | Norway | 102/532 |
| 675769 | 10/1990 | Switzerland | 102/523 |
| 7090 | of 1887 | United Kingdom | 102/469 |
| 20897 | of 1890 | United Kingdom | 102/469 |

*Primary Examiner*—Harold J. Tudor
*Attorney, Agent, or Firm*—Perman & Green

[57] ABSTRACT

A cartridge for a powder actuated tool having a cartridge case, a powder propellant, a bushing, and a piston. The piston has a tapered outer diameter that is larger in a rear end of the piston and is compressed inward by the cartridge case. A port extends through the piston and has an entrance to the port at a rear end of the piston with a semi-spherical shape to slow gas flow rate passing through the port and reduce the amount of propellant residue passing through the port. The piston has a main section and a cantilevered section. The cantilevered section has a general ring shape and forms a portion of the outer diameter of the piston.

9 Claims, 1 Drawing Sheet

CARTRIDGE FOR A POWER DRIVEN TOOL

BACKGROUND OF THE INVENTION

1. Field of the Invention

The present invention relates to a cartridge for power driven tools and, more particularly, to a cartridge having an improved piston and bushing in the cartridge.

2. Prior Art

U.S. Pat. Nos. 4,945,730 and Re. 33,098 disclose power/powder actuated tools that use cartridges. U.S. Pat. No. 5,005,485 discloses a cartridge for use in such tools. U.S. Pat. Nos. 2,920,563; 3,404,598; and 3,424,088 show other types of cartridges.

SUMMARY OF THE INVENTION

In accordance with one embodiment of the present invention, in a cartridge for a powder actuated tool, the cartridge having a cartridge case, a propellant, a bushing, and a piston, the improvement comprises the piston having a tapered outer diameter that is larger in a rear end of the piston and is compressed inward by the cartridge case.

In accordance with another embodiment of the present invention, in a cartridge for a powder actuated tool, the cartridge having a cartridge case, a propellant, a bushing and a piston having a port therethrough, the improvement comprises the piston having an entrance to the port at a rear end of the piston with a semi-spherical shape to slow gas flow rate passing through the port and reduce the amount of propellant residue passing through the port.

In accordance with another embodiment of the invention, cartridge for a powder actuated tool, the cartridge having a cartridge case, a propellant, a bushing, and a piston, the improvement comprises the piston having a main section and a cantilevered section, the cantilevered section has a general ring shape and forms at least a portion of an outer diameter of the piston.

In accordance with another embodiment of the present invention, in a cartridge for a powder actuated tool, the cartridge having a cartridge case, a propellant, a piston, and a bushing, the bushing having an outer diameter with a riser section forming a step between two different sizes outer diameter sections of the bushing, the improvement comprises the riser section having an outer surface that faces towards a rear end of the bushing and is angled relative to a center axis of the bushing at an angle that is less than perpendicular to the center axis.

BRIEF DESCRIPTION OF THE DRAWINGS

The forgoing aspects and other features of the invention are explained in the following description, taken in connection with the accompanying drawings, wherein.

DETAILED DESCRIPTION OF THE PREFERRED EMBODIMENT

Figure 1:
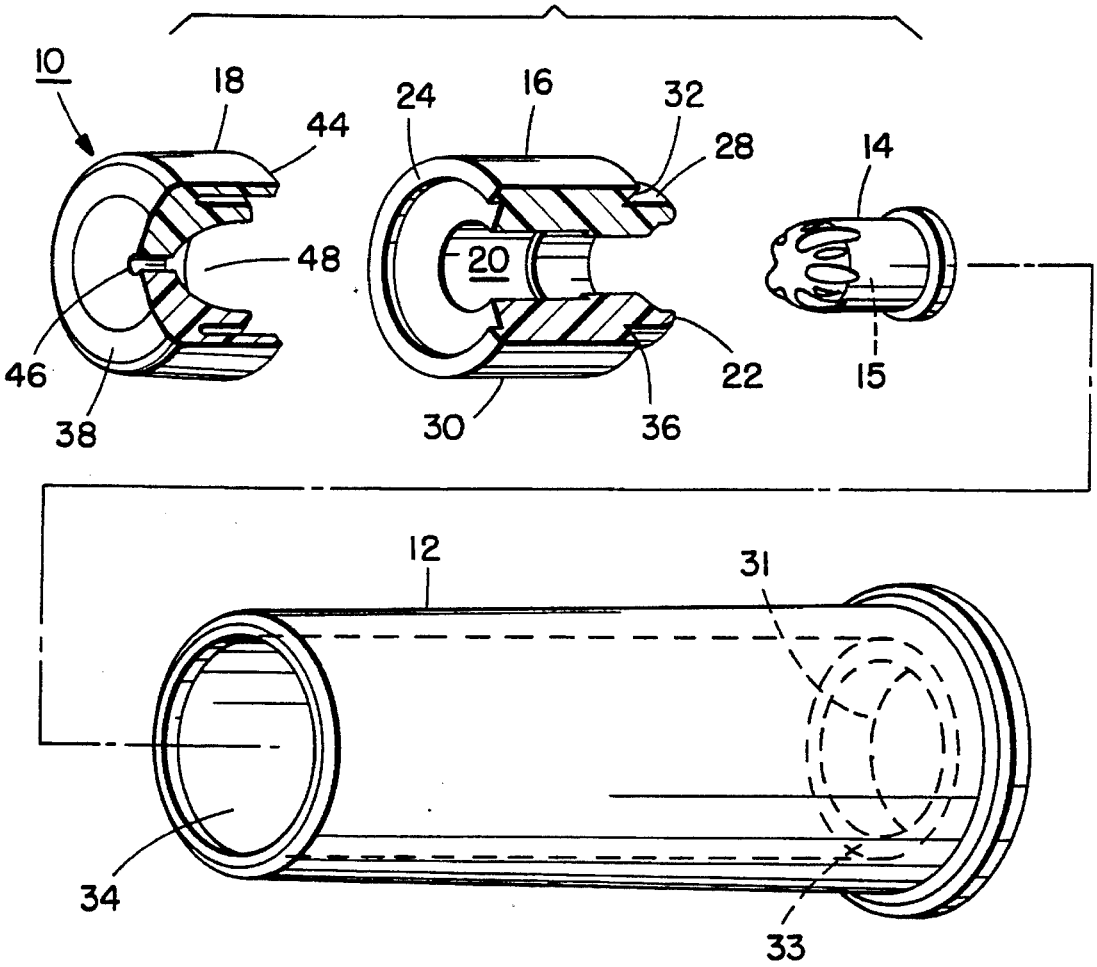
FIG. 1 is an exploded perspective view of a cartridge incorporating features of the present invention with cutaway sections of the piston and bushing.
Figure 2:
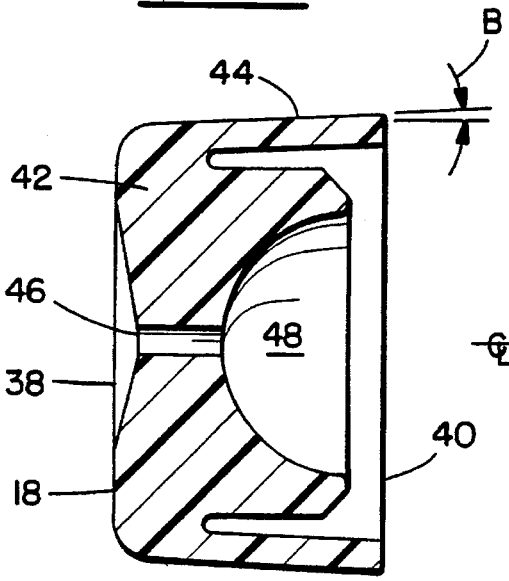
FIG. 2 is a cross-sectional view of the piston shown in FIG. 1.

Referring to FIG. 1, there is shown an exploded perspective view of a cartridge 10 incorporating features of the present invention. Although the present invention will be described with reference to the single embodiment shown in the drawings, it should be understood that features of the present invention could be embodied in various different forms of embodiment. In addition, any suitable size, shape or type of materials or elements could be used.

The cartridge 10 generally comprises a cartridge case 12, a power cell 14, a bushing 16, and a piston 18. The cartridge case 12 is adapted to hold the bushing 16 and the piston 18. The cartridge case 12 is generally known in the prior art. However, other suitable types of cartridge cases could be used. The power cell 14 is also generally known in the prior art. The power cell 14 includes a powder propellant 15 located therein. In alternate embodiments the propellant located inside the power cell 14 could be in a form other than powder. In addition, any suitable type of power cell could be used.

Figure 3:
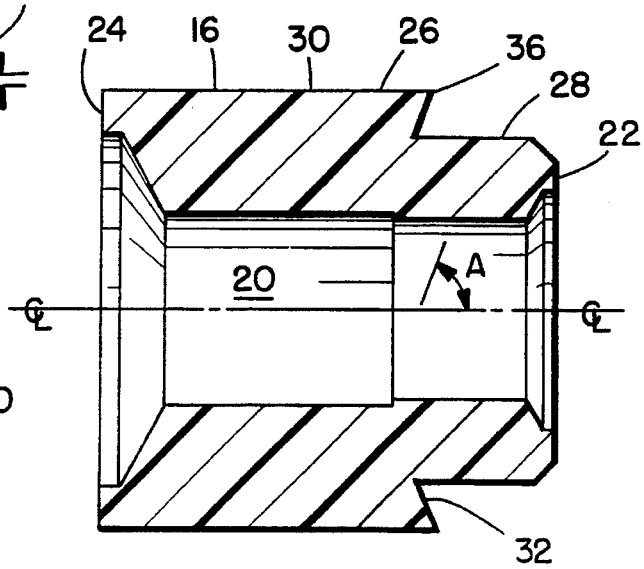
FIG. 3 is a cross-sectional view of the bushing shown in FIG. 1.

The bushing 16 is preferably made of a plastic or polymer material. However any suitable type of material could be used. Referring also to FIG. 3, the bushing 16 has a center aperture 20 extending from a rear end 22 to a front end 24. The aperture 20 is suitably sized and shaped to mount the power cell 14 located therein. The outer side surface 26 of the bushing 16 has a first outer diameter section 28 with a first size, a second outer diameter section 30 with a second larger size, and a third riser section 32 between the first and second sections 28, 30. The riser section 32 has an outer surface that faces towards the rear end 22 of the bushing 16. The outer surface of the riser section 32 is angled relative to a center axis of the bushing 16 at an angle A that is less than perpendicular to the center axis. In a preferred embodiment the angle A is about 82°. However, any suitable angle could be provided. The interior of the cartridge case 12 is substantially the same as that shown in U.S. Pat. No. 5,005,485 which is hereby incorporated by reference in its entirety. The first section 28 is matingly received in a rear end aperture 31 of the case 12. The second section 30 has a constant outer diameter and is matingly received in the main bore 34 of case 12. The outer tip 36 of the third section 32 of the bushing 16 makes contact against a shoulder 33 of the case 12 located at the junction between the rear end aperture 31 of the case 12 and the main bore 34. The rest of the outer surface of the third section 32 is slightly spaced from the shoulder 33 of the case 12 before the cartridge is fired.

The piston 18 is also preferably made of a plastic or polymer material. However, any suitable type of material could be used. The piston 18 has a front end 38, a rear end 40, a main section 42 and a cantilever section 44. The main section 42 forms the front end 38 and has a port 46 therethrough. The port 46 has an entrance 48 thereto located proximate the rear end 40 of the piston 18. The entrance 48 has a general semi-spherical shape. The semi-spherical shape has been found to be particularly adapt in slowing the gas flow rate of gases passing through the port 46 and reducing the amount of propellant residue passing through the port 46. The cantilever section 44 has a general ring shape that partially surrounds the main section 42. The cantilever section 44 is inwardly deflected when inserted into the cartridge case 12. The outer diameter of the piston 18, before insertion into the cartridge case 12, increases from the front end 38 towards the rear end 40 to form a tapered outer diameter. Preferably the slope of increase is at an angle B of about 1.7°. However, any suitable type of angle could be provided. When the piston 18 is inserted into the cartridge case 12 the cantilever ring section 44 is compressed and slightly deflected by the walls of the cartridge case. Thus, the cantilever section 44 is spring biased against the interior surface of the cartridge case 12 in the main bore 34 to form a good seal with the cartridge case 12. However, the piston 18 can still readily move in the main bore 34 when the power cell 14 is fired.

When the cartridge 10 is fired, gases from the propellant 15 burning in the power cell 14 exit the front of the power cell 14. The gases travel through the aperture 20 into the entrance 48. The force exerted by the gases against the piston 18 causes the piston to move forward in the main bore 34 of the case 12. The shape of the entrance 48 slows the rate of gases exiting through the port 46. This reduces the amount of combustion residue from the propellant that passes out of the cartridge 10 and into the tool. The tapered outer diameter of the piston 18 seal in the residue and also allows for reduction of friction forces between the piston and the cartridge case. The gases also exert a reward force on the bushing 16. This rearward force compresses substantially the entire rearward facing outer face of the third section 32 against the interior shoulder 33 of the case; the bushing 16 deforms slightly to accomplish this mating. The deforming compression of the third section 32 against the shoulder 33 forms a seal that increases as the force from the expanding gases increases. It should be understood that other embodiments of the present invention could include different types of bushings, different types of pistons, and different sealing methodologies.

It should be understood that the foregoing description is only illustrative of the invention. Various alternatives and modifications can be devised by those skilled in the art without departing from the spirit of the invention. Accordingly, the present invention is intended to embrace all such alternatives, modifications and variances which fall within the scope of the appended claims.

What is claimed is:

1. In a cartridge for a powder actuated tool, the cartridge having a cartridge case, a propellant, a bushing, and a piston, the improvement comprising:

the piston having a tapered outer diameter that is larger in a rear end of the piston and is compressed inward by the cartridge case, wherein the piston has a port therethrough and a semi-spherical entrance to the port at the rear end of the piston.

2. A cartridge as in claim 1 wherein the piston has a main section and a general ring shaped cantilever section, the cantilever section forming at least a portion of the outer diameter of the piston.

3. A cartridge as in claim 2 wherein a portion of the main section is located inside the ring shape of the cantilever section.

4. A cartridge as in claim 1 wherein the outer diameter is tapered at an angle of about 1.7° along the length of the piston.

5. In a cartridge for a powder actuated tool, the cartridge having a cartridge case, a propellant, a bushing and a piston having a port therethrough, the improvement comprising: the piston having an entrance to the port at a rear end of the piston with a semi-spherical shape to gas flow rate passing through the port and reduce the amount of propellant residue passing through the port.

6. A cartridge as in claim 5 wherein the piston has a main section with the port and entrance located therein, and a deflectable cantilever ring section surround a portion of the main section.

7. A cartridge as in claim 6 wherein the ring section has an outer diameter that increases towards the rear end of the piston.

8. A cartridge as in claim 7 wherein the outer diameter increases at an angle of about 1.7°.

9. A cartridge as in claim 7 wherein the ring section is compressed and slightly deflected by walls of the cartridge case.

* * * * *